US007984747B2

(12) United States Patent
Takeuchi et al.

(10) Patent No.: US 7,984,747 B2
(45) Date of Patent: Jul. 26, 2011

(54) CONTROL METHOD FOR SUPPLYING INERT GAS DURING METAL MOLDING

(75) Inventors: Yasuhiko Takeuchi, Nagano-ken (JP); Mamoru Miyagawa, Nagano-ken (JP); Ikuo Uwadaira, Nagano-ken (JP)

(73) Assignee: Nissei Plastic Industrial Co., Ltd., Hanishina-gun, Nagano-ken (JP)

( * ) Notice: Subject to any disclaimer, the term of this patent is extended or adjusted under 35 U.S.C. 154(b) by 319 days.

(21) Appl. No.: 12/356,768

(22) Filed: Jan. 21, 2009

(65) Prior Publication Data

US 2009/0188644 A1 Jul. 30, 2009

(30) Foreign Application Priority Data

Jan. 28, 2008 (JP) ..... 2008-016354

(51) Int. Cl.

| | |
|---|---|
| ***B22D 17/20*** | (2006.01) |
| ***B22D 17/32*** | (2006.01) |
| ***B22D 18/00*** | (2006.01) |
| ***B22D 46/00*** | (2006.01) |

(52) U.S. Cl. ..... 164/4.1; 164/66.1; 164/259; 164/151.4; 164/154.6; 164/154.8

(58) Field of Classification Search ..... 164/66.1, 164/259, 4.1, 151.1, 151.4, 154.6, 154.8
See application file for complete search history.

(56) References Cited

U.S. PATENT DOCUMENTS 6,487,905 B2 * 12/2002 Koda et al. ..... 73/299

FOREIGN PATENT DOCUMENTS

JP 2002-361386 A * 12/2002
JP 2002361386 12/2002

* cited by examiner

*Primary Examiner* — Kevin P Kerns
(74) *Attorney, Agent, or Firm* — Weingarten, Schurgin, Gagnebin & Lebovici LLP

(57) ABSTRACT

A control method for supplying an inert gas from an inert gas source to a storage container for a molten metal through a gas feed path provided with a flow sensor for monitoring the gas flow rate and a solenoid valve for opening and closing the gas feed path for use with metal molding. The control method includes steps of turning off the solenoid valve if a temperature of the storage container is lower than a preset temperature, and turning off the flow sensor; otherwise turning on the solenoid valve and turning on the flow sensor; and stopping the output of the heater of the storage container when the gas flow rate is lower than the preset amount; these steps are controlled in accordance with a command signal from a controller.

5 Claims, 2 Drawing Sheets

CONTROL METHOD FOR SUPPLYING INERT GAS DURING METAL MOLDING

BACKGROUND OF THE INVENTION

1. Field of the Invention

The present invention relates to a control method for supplying an inert gas into a storage container having a heater, the control method being employed when ingots or metal materials cast in bar shapes are melted and retained in the storage container, and the molten material is fed to a metal molding apparatus to produce metal products.

2. Description of the Related Art

Conventionally, a technique is known for supplying an inert gas into a melting container in order to prevent oxidation of the melt retained in the melting container (for example, see Japanese Patent Application Laid-Open No. 2001-311643 which corresponds to U.S. Patent No. 6,487,905). Means for supplying an inert gas is also known which serves to reduce the consumption of the inert gas as well as to address drawbacks of excessive throttling or valve closing with a proportional flow regulator (for example, see Japanese Patent Application Laid-Open No. 2002-361386). In the supplying means, an inert gas tank is connected to the proportional flow regulator via a conduit to supply the inert gas to both a hopper and a nozzle at a cylinder tip through the proportional flow regulator. Then, a cylinder temperature determined by a temperature sensor is compared with a temperature derived from a temperature table having been set in advance in a stepwise manner, thereby controlling the degree of opening of the proportional flow regulator. The supplying means can provide automatic variable control to the amount of the inert gas being supplied in accordance with the cylinder temperature.

The above control method for supplying the inert gas provides control to the degree of opening of the proportional flow regulator based on the comparison between the cylinder temperature and a temperature derived from the temperature table set in advance. This control method can supply the inert gas corresponding to the cylinder temperature, thereby saving the inert gas and solving the drawbacks of poor flow regulation. However, the supply control carried out based on the comparison between the cylinder temperature and a temperature derived from the temperature table is not intended as a countermeasure against a gas supply shortage caused by its depletion while the gas-supply operation is continued. Accordingly, the shortage of the inert gas does not allow the metal material to be melted and retained in an atmosphere of the inert gas. It is thus difficult to prevent the occurrence of a large amount of impurities resulting from oxidation of the molten metal material or to prevent the material from catching fire due to the oxidation.

SUMMARY OF THE INVENTION

The present invention has been achieved in order to solve the foregoing problems that are associated with the conventional inert gas supply control methods. It is thus an object of the present invention to provide a novel control method for supplying an inert gas during metal molding. In this control method, the temperature of the storage container for the molten metal material and the flow rate of the gas are monitored to detect the depletion of the inert gas at a temperature equal to or higher than a preset temperature and control the container temperature. This allows for preventing the occurrence of a large amount of impurities within the storage container as well as preventing the molten metal material from catching fire. The control method can also serve to reduce the consumption of the inert gas and prevent environmental destruction that may be caused by the inert gas emission.

To achieve the foregoing object, the present invention provides a control method for supplying an inert gas for use with a metal molding apparatus. The apparatus includes: an inert gas source; a storage container for a molten metal, the storage container provided with a heater; a gas feed path from the inert gas source to the storage container; a flow sensor for monitoring a flow rate of the inert gas; a solenoid valve for opening and closing the gas feed path between the storage container and the inert gas source, wherein, the flow sensor and the solenoid valve being provided sequentially in the gas feed path; a temperature detector for detecting a temperature of the storage container; and a controller for controlling the monitoring of the flow rate of the inert gas with the flow sensor, the opening and closing of the gas feed path with the solenoid valve, and the output of the heater, by receiving respective signals from the flow sensor and the temperature detector.

In the metal molding apparatus with this configuration, the control method includes the following steps: outputting the heater; turning off the solenoid valve, after said outputting of the heater, to stop supplying the inert gas to the storage container in accordance with a command signal from the controller at a temperature detected at the storage container that is equal to or lower than a preset temperature, and turning off the monitoring of the gas flow rate with the flow sensor; turning on the solenoid valve to start supplying a preset amount of the inert gas in accordance with another command signal from the controller at a temperature detected at the storage container that has reached the preset temperature, and turning on the flow sensor to start the monitoring of the gas flow rate; and stopping the output of the heater on the storage container in accordance with another command signal from the controller having determined that the gas is being abnormally supplied at a flow rate of the inert gas detected with the flow sensor that is equal to or lower than the preset amount.

Furthermore, in the control method the monitoring of the flow rate of the inert gas with the flow sensor can be delayed using a timer setting with respect to the solenoid valve being turned on.

Furthermore, the storage container employed in the control method can include a storage tank having the heater on the periphery of the storage tank and, on top of the storage tank, a melting barrel for melting a bar-shaped metal material, and the storage tank is connected with the gas feed path.

In the above configuration, both the detection of the temperature of the storage container for the molten metal material and the monitoring of the inert gas flow rate are employed to control the supply of the gas. Thus, even when a supply shortage occurs due to gas depletion in the course of supply, the monitoring of the flow rate with the flow sensor can sense a supply shortage and then stop the output from the heater on the storage container. It is thus possible to prevent the occurrence of a large amount of impurities resulting from oxidation of the metal material caused by a gas shortage at the preset temperature or higher. The metal material can also be prevented from catching fire due to the oxidation.

Furthermore, since the gas supply is started after the container temperature has reached the preset temperature, the consumption of the inert gas is reduced. If an anti-fire gas or, $SF_6$ gas, which may cause environmental destruction, is employed as the inert gas, the reduction of the use amount thereof can contribute environmental protection measures.

In the apparatus, the flow sensor for monitoring of the gas flow rate and the solenoid valve for opening and closing gas feed paths are disposed in a typical gas feed path so that the flow sensor and the solenoid valve are operated based on the command from the controller when the controller receives the temperature signal from the container temperature detector. Accordingly, the apparatus can be configured in a simple manner without requiring expensive devices for temperature detection and flow monitoring. The apparatus can also be configured without regard to the structure of the storage container.

DETAILED DESCRIPTION OF THE PREFERRED EMBODIMENTS

Figure 1:
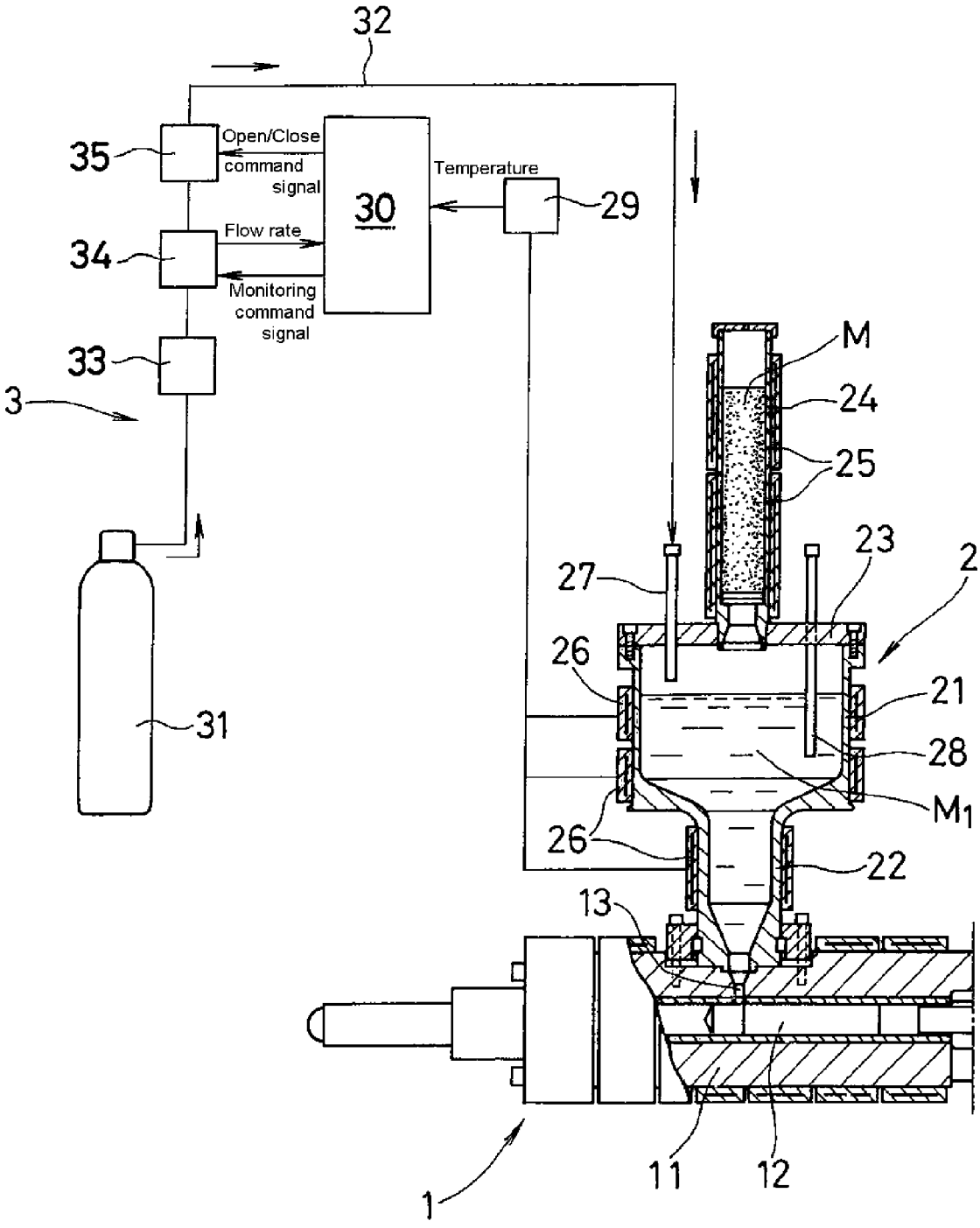
FIG. 1 is an explanatory view illustrating a metal molding apparatus and a system which can employ an inert gas supply control method according to the present invention.

In FIG. 1, the reference numeral 1 denotes an injection cylinder of an injection metal molding apparatus, the reference numeral 2 denotes a storage container disposed on the front top of the injection cylinder 1 to retain a molten metal material (melt), and the reference numeral 3 denotes a supply system for supplying an anti-fire/anti-oxidation inert gas.

The injection cylinder 1 has a typical configuration with an injection plunger 12, movable back and forth, at the center inside a cylinder body 11 having a nozzle at its tip, and a feed opening 13 disposed above the retracted position of the injection plunger 12. The storage container 2 is installed upright above the feed opening 13.

The storage container 2 includes a storage tank 21 circular in its plan view, a barrel body 22 integrated therewith at the center of the bottom of the storage tank 21 and elongated downwardly with a reduced diameter, and a lid member 23 of the storage tank 21. The lid member 23 has a melting barrel 24 disposed upright thereon to melt a round bar-shaped metal material M. A number of band heaters 25 and 26 are arranged around the peripheries of the melting barrel 24, the storage tank 21, and the barrel body 22. The band heaters 25 and 26 are independently controllable in temperature. The metal material M melted in the melting barrel 24 is retained in the storage container 2 as a molten metal material $M_1$ at a present temperature held by the heater heating from the peripheries thereof. The storage container 2 also has a gas feed pipe 27 and a level meter 28 which penetrate the lid member 23.

The gas supply system 3 includes a gas cylinder 31 serving as an anti-fire/anti-oxidation inert gas source, and a gas feed path 32 interposed between the gas cylinder 31 and the gas feed pipe 27. The system 3 also includes a reducing valve 33, a flow sensor 34 used for monitoring a flow rate and integrated with a flow meter, and a solenoid valve 35 for opening and closing the gas feed path, which are provided on the gas feed path 32 sequentially from the gas cylinder 31 in this order. The flow sensor 34 and the solenoid valve 35 are controlled based on a command signal from a controller 30 which receives a temperature signal provided by a temperature detector 29 detecting the temperature of the storage container 2 all the time. More specifically, the command signal causes the flow sensor 34 to perform monitoring and the solenoid valve 35 to conduct opening and closing operations.

Furthermore, a timer setting is used to allow the flow sensor 34 to start monitoring with a delay after the solenoid valve 35 has started opening. This is done for the following reason. Immediately after the solenoid valve 35 has started opening, the flow rate of the gas is likely below the preset flow rate and thus the simultaneous starts of the opening and monitoring would cause an erroneous operation. To prevent this from happening, a timer is employed to start flow rate monitoring with a delay of about a few seconds (for example, 5 seconds).

Figure 2:
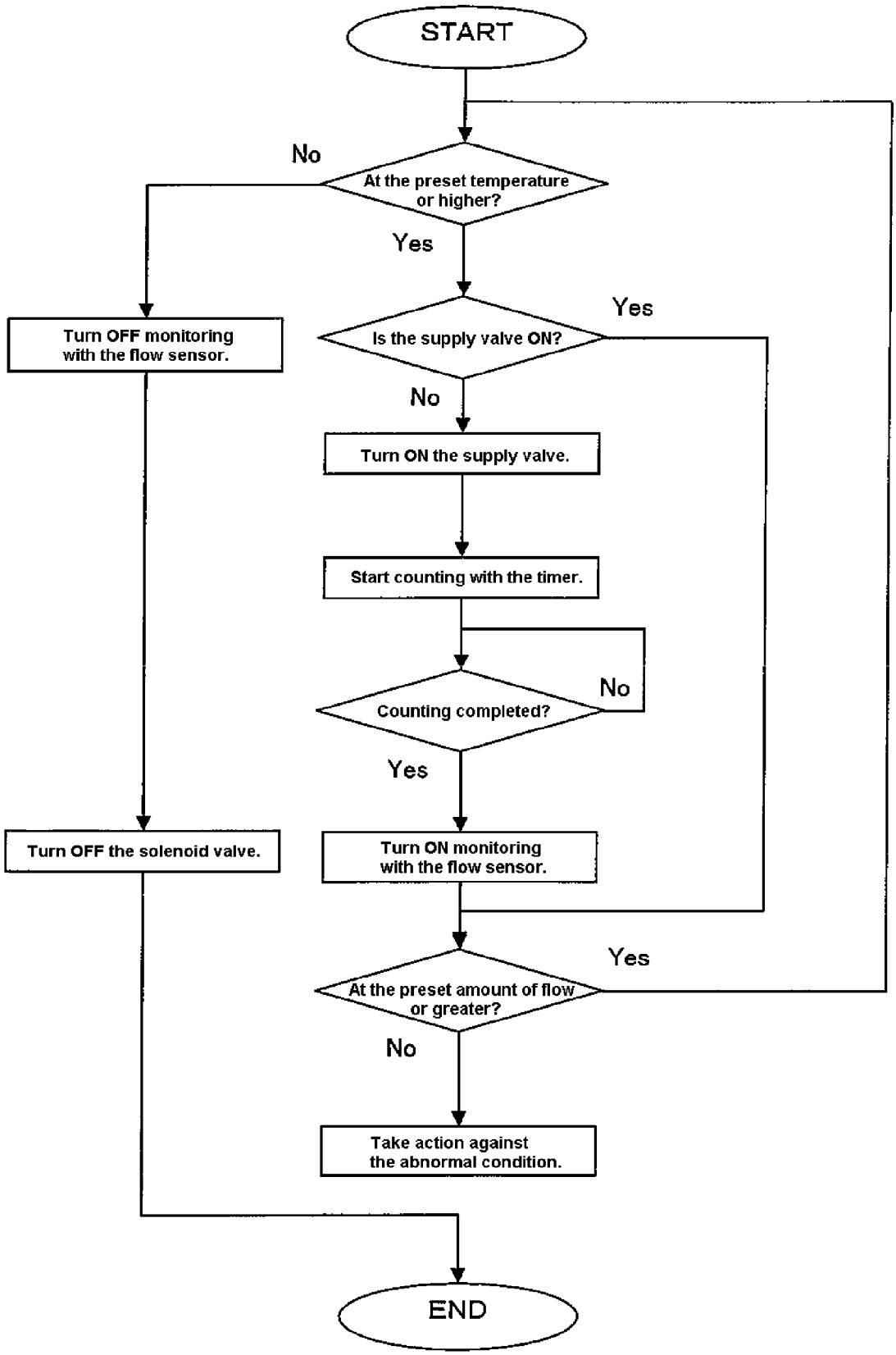
FIG. 2 is a flowchart showing the steps for supplying an inert gas according to the present invention.

FIG. 2 is a flowchart showing the process for supplying an inert gas in the gas supply system 3. The process is triggered at the beginning of molding to start heating the storage container 2 and activating the temperature detector 29. The process also starts heating the melting barrel 24 to melt the metal material M and retain the molten metal material $M_1$ in the storage container 2.

With both the monitoring by the flow sensor and the solenoid valve kept off, no inert gas is supplied until the temperature of the storage container 2 (hereinafter referred to as "the container temperature") gradually increases and then reaches a preset temperature (300° C. for a magnesium alloy as the metal material). This is because impurities would only slightly occur due to oxidation of the metal material below the preset temperature, and thus the molten metal material $M_1$ needs not be retained in an atmosphere of the inert gas. This helps save the inert gas, so that even when a $SF_6$ gas, likely to cause environmental destruction, is used as an anti-fire gas, the amount of its use can be cut down. This in turn will contribute to environmental protection measures.

When the container temperature has reached the preset temperature, the controller 30 receives the temperature signal detected by the temperature detector 29 and issues a command signal to turn on the solenoid valve. Thus, the inert gas is supplied from the gas cylinder 31 into the storage container 2 through the gas feed path 32. Simultaneously, a command signal for turning on monitoring is also delivered to the flow sensor 34 to allow the timer to start counting, so that after the counting is completed, the flow sensor is turned on to start monitoring the flow rate of the gas.

The gas flow rate is continually monitored as it is, and the solenoid valve is kept on to continue to supply the gas if the gas is flowing at a preset amount or greater and the container temperature detected by the temperature detector 29 is at the preset temperature or higher. When the inert gas flows at the pre-set amount for some reason, the controller 30 receives the flow signal and issues a command signal, indicative of the gas being abnormally supplied, to immediately stop the output from the heater on the storage container 2. The controller 30 also issues an error indication or an alarm to inform the operator of the abnormal supply of the gas.

Thus, even upon gas depletion during the supply of the gas, the monitoring of the flow rate by the flow sensor serves to stop the output from the heater on the storage container. It is thus possible to prevent the occurrence of a large amount of impurities resulting from oxidation of the metal material caused by a gas shortage at the preset temperature or higher as well as to prevent the metal material from catching fire due to the oxidation.

On the other hand, the temperature detector 29 may detect the container temperature having fallen down below the preset temperature when the gas is flowing at the preset amount or greater. In this case, the controller 30 which has received the temperature signal issues command signals to turn off the monitoring of the flow rate with the flow sensor and turn off the solenoid valve. Thus, the supply of the inert gas is stopped from the gas cylinder 31 to the storage container 2, thereby preventing wasteful supply of the gas below the preset temperature.

What is claimed is:

1. A control method for supplying an inert gas for use with a metal molding apparatus, the apparatus including:

an injection cylinder, for injecting a molten metal, having an injection plunger, movable back and forth, at the center inside a cylinder body having a nozzle thereat a tip, and a feed opening disposed above a retracted position thereof;

an inert gas source;

a storage container for retaining the molten metal, the storage container provided with a heater and above the feed opening;

a gas feed path from the inert gas source to the storage container;

a flow sensor for monitoring a flow rate of the inert gas;

a solenoid valve for opening and closing the gas feed path between the storage container and the inert gas source, wherein the flow sensor and the solenoid valve are provided sequentially in the gas feed path;

a temperature detector for detecting a temperature of the storage container; and a controller for controlling the monitoring of the flow rate of the inert gas with the flow sensor, the opening and closing of the gas feed path with the solenoid valve, and an output of the heater, by receiving a flow signal concerning a flow rate of the inert gas from the flow sensor and a temperature signal concerning the temperature of the storage container from the temperature detector, the controlling step comprising the steps of:

outputting the heater;

turning off the solenoid valve, after said outputting of the heater, to stop supplying the inert gas to the storage container in accordance with a command signal from the controller at a temperature detected at the storage container that is lower than a preset temperature, and turning off the monitoring of the gas flow rate with the flow sensor;

turning on the solenoid valve to start supplying a preset amount of the inert gas in accordance with another command signal from the controller at a temperature detected at the storage container that has reached the preset temperature, and turning on the flow sensor to start the monitoring of the gas flow rate; and stopping the output of the heater on the storage container in accordance with another command signal from the controller having determined that the gas is being abnormally supplied at a flow rate of the inert gas detected with the flow sensor that is lower than the preset amount.

2. The control method according to claim 1, wherein the monitoring of the flow rate of the inert gas with the flow sensor is delayed using a timer setting with respect to the solenoid valve being turned on.

3. The control method according to claim 1, wherein the storage container includes a storage tank having the heater on the periphery of the storage tank and, on top of the storage tank, a melting barrel for melting a bar-shaped metal material, and the storage tank is connected with the gas feed path.

4. The control method according to claim 1, wherein the control method further comprising stopping the supplying of the inert gas to the storage container, when the temperature detected at the storage container have fallen down to a temperature lower than the preset temperature and the flow rate of the inert gas to the storage container is the preset amount or greater.

5. A control method for supplying an inert gas for use with a metal molding apparatus, the apparatus including:

an inert gas source;

a storage container for retaining the molten metal, the storage container provided with a heater and above the feed opening;

a gas feed path from the inert gas source to the storage container;

a flow sensor for monitoring a flow rate of the inert gas;

a solenoid valve for opening and closing the gas feed path between the storage container and the inert gas source, wherein the flow sensor and the solenoid valve are provided sequentially in the gas feed path;

a temperature detector for detecting a temperature of the storage container; and a controller for controlling the monitoring of the flow rate of the inert gas with the flow sensor, the opening and closing of the gas feed path with the solenoid valve, and an output of the heater, by receiving a flow signal concerning a flow rate of the inert gas from the flow sensor and a temperature signal concerning the temperature of the storage container from the temperature detector, the controlling step comprising the steps of:

outputting the heater;

turning off the solenoid valve, after said outputting of the heater, to stop supplying the inert gas to the storage container in accordance with a command signal from the controller at a temperature detected at the storage container that is lower than a preset temperature, and turning off the monitoring of the gas flow rate with the flow sensor;

turning on the solenoid valve to start supplying a preset amount of the inert gas in accordance with another command signal from the controller at a temperature detected at the storage container that has reached the preset temperature, and turning on the flow sensor to start the monitoring of the gas flow rate; and stopping the output of the heater on the storage container in accordance with another command signal from the controller having determined that the gas is being abnormally supplied at a flow rate of the inert gas detected with the flow sensor that is lower than the preset amount.

* * * * *